United States Patent [19]

Apter et al.

[11] 4,323,333

[45] Apr. 6, 1982

[54] PISTON METERING PUMP

[75] Inventors: Robert Apter, Wyncote; John Philippi, Horsham; Nicholas Potichko; Fred. C. Szablewski, both of Lansdale, all of Pa.

[73] Assignee: R. A. Industries, Lansdale, Pa.

[21] Appl. No.: 96,951

[22] Filed: Nov. 23, 1979

[51] Int. Cl.[3] ..... F04B 21/02

[52] U.S. Cl. ..... 417/63; 74/44; 92/13.8; 417/568

[58] Field of Search ..... 417/536, 568, 63; 74/44; 92/129, 13.8, 13.6, 13.51

[56] References Cited

U.S. PATENT DOCUMENTS

| | | | |
|---|---|---|---|
| 1,690,646 | 11/1929 | Meyer | 92/13.8 X |
| 2,291,889 | 8/1942 | Evans et al. | 92/13.8 X |
| 2,771,846 | 11/1956 | Horton et al. | 92/13.8 X |
| 2,962,904 | 12/1960 | Soccart | 74/44 |
| 3,168,011 | 2/1965 | Baumann | 92/13.8 X |
| 3,410,477 | 11/1968 | Hartley | 417/534 |
| 3,830,139 | 8/1974 | Wachsman et al. | 92/13.8 X |

OTHER PUBLICATIONS

A & F Machine Products Co. Catalog Excerpt, 3 pages date unknown.

*Primary Examiner*—Carlton R. Croyle
*Assistant Examiner*—Edward Look
*Attorney, Agent, or Firm*—Seidel, Gonda, Goldhammer and Panitch

[57] ABSTRACT

The piston metering pump has a motor operated eccentric which reciprocates a piston assembly. The piston assembly has two separate portions connected by spaced wire or rod members. One of said portions supports the piston and the other portion supports a coaxial stroke adjustment member.

6 Claims, 4 Drawing Figures

PISTON METERING PUMP

BACKGROUND

Piston metering pumps of the general type involved herein are old and well known. In such prior art pumps, the portion of the piston assembly cooperating with the motor driven eccentric is machined from bar stock in a manner which requires several different types of machinery, requires great skill, is time consuming, whereby the piston assembly is an expensive component of the pump.

The present invention recognizes these disadvantages of the prior art and teaches the novel structural interrelationship which minimizes the cost of manufacture of the piston assembly with less capital equipment and less skill being required.

SUMMARY OF THE INVENTION

The present invention is directed to a metering pump of the piston type. A housing has an inlet and outlet. The piston assembly includes first and second coaxial portions guided for reciprocation. One of said portions includes a piston arranged to pressurize fluid admitted into the housing from the inlet and cause discharge of such fluid through said outlet.

The first and second portions of said piston assembly are interconnected by a pair of third portions. Said third poritions each have one end bonded to one end of said first portion and have their other end bonded to one end of said second portion. Said third portions are disposed to one side of the axis of said first and second poritons to thereby define a gap between said first and second portions.

The second portion includes a coaxial stroke member adjustably supported thereby for adjusting the effective length of the gap which in turn determines the length of the piston stroke. A motor has an eccentric in said gap between said stroke member and said first member for causing reciprocation of the piston.

It is an object of the present invention to provide a piston metering pump wherein the piston assembly is constructed in a manner so as to be less expensive, require less capital equipment, and require less skill in manufacturing the same.

Other objects and advantages will appear hereinafter.

For the purpose of illustrating the invention, there is shown in the drawings a from which is presently preferred; it being understood, however, that this invention is not limited to the precise arrangements and instrumentalities shown.

Figure 1:
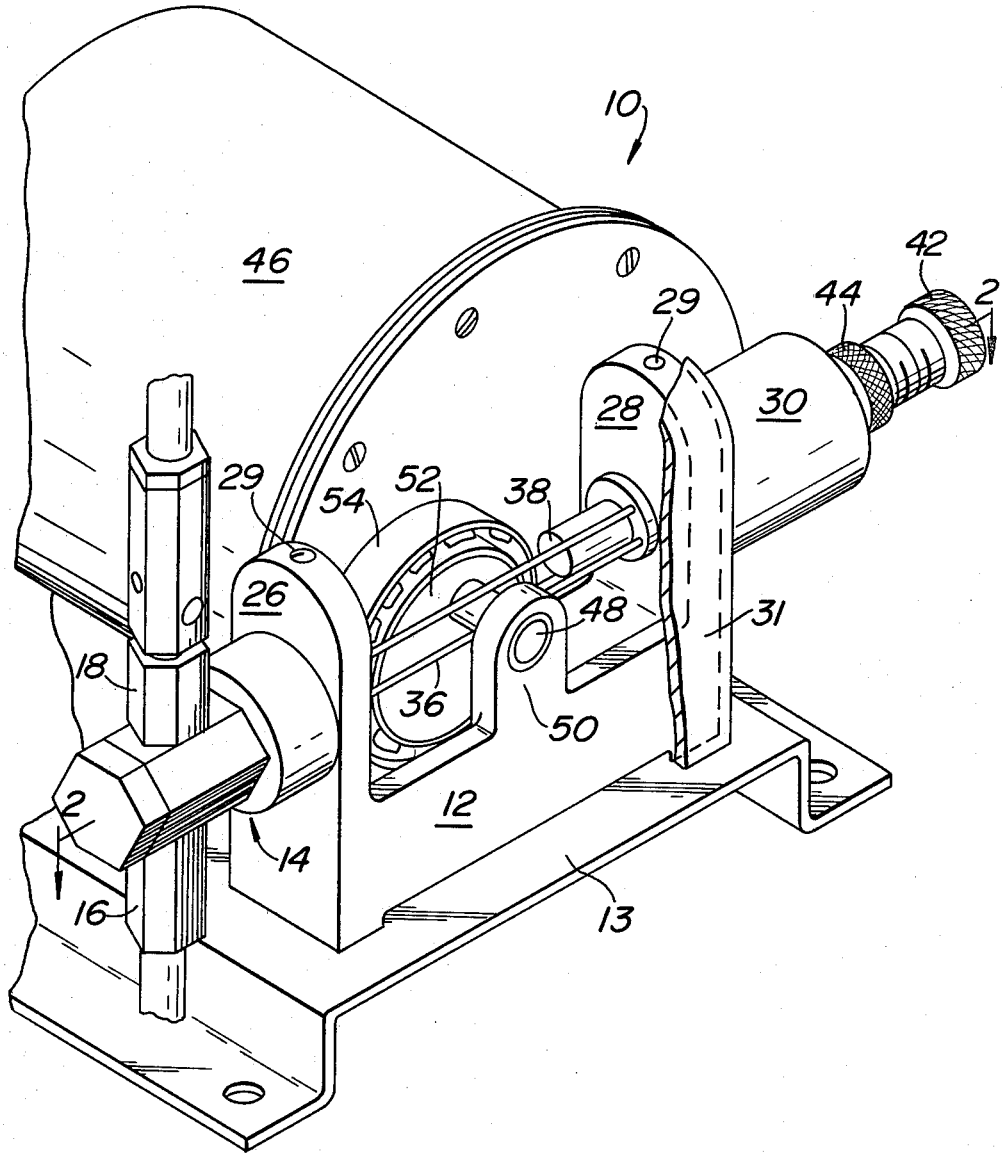
FIG. 1 is a perspective view of a pump in accordance with the present invention.

Referring to the drawing in detail, wherein like numerals indicate like elements, there is shown a metering pump 10 of the positive type for feeding chemicals and other liquids at high pressures at low volume.

The pump 10 includes a housing 12 mounted on a base plate 13 and having a liquid control portion 14. Portion 14 includes an inlet 16 and an outlet 18 communicating with a chamber therein. Each of the inlet and outlet have check valves. The structural interrelationship of portion 14 with the inlet and outlet is conventional and therefore need not be described in detail.

Figures 3, 4:
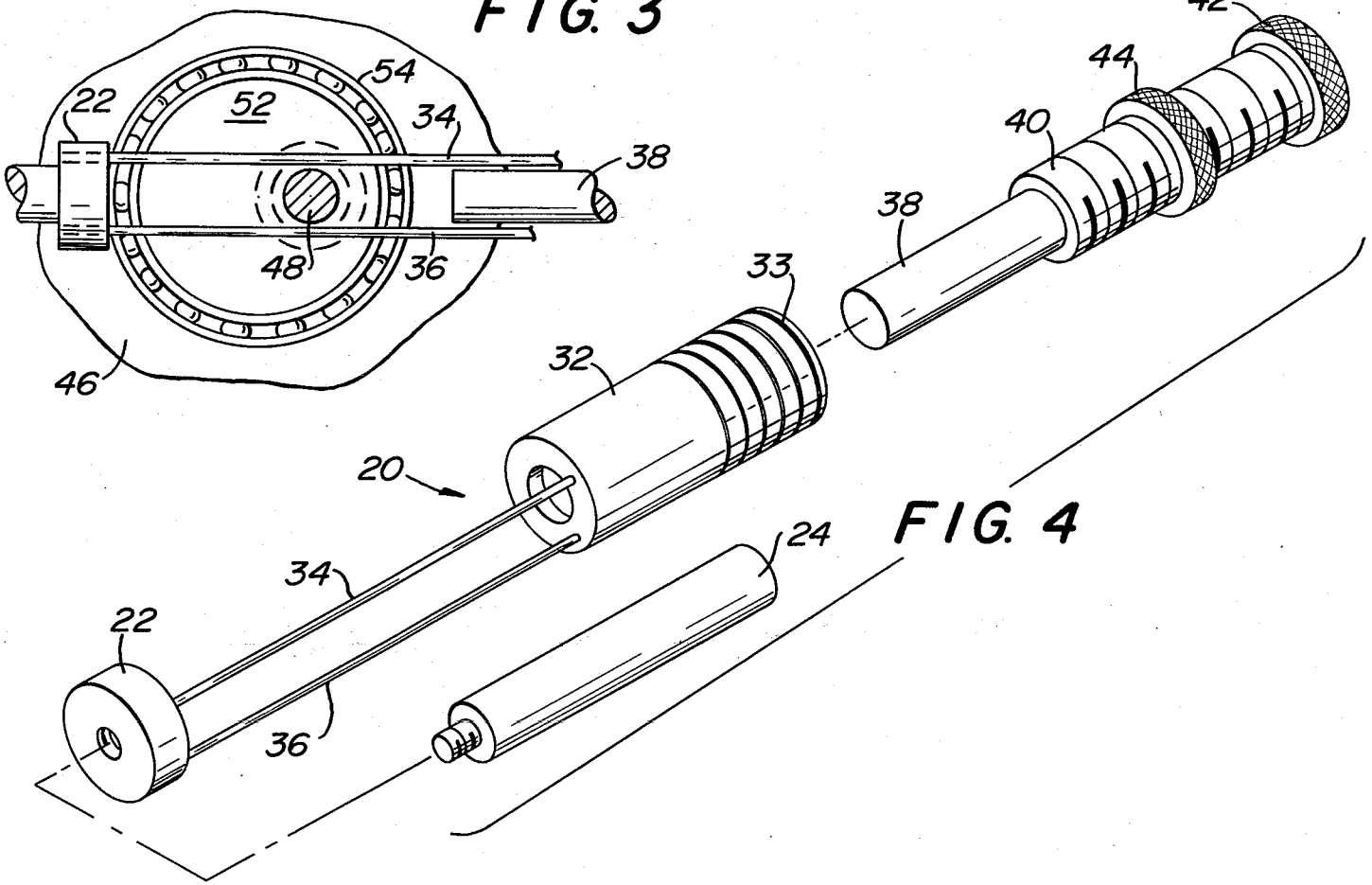
FIG. 3 is a sectional view taken along the line 3—3 in FIG. 2.
FIG. 4 is an exploded view of the compliments of the piston assembly.

As shown more clearly in FIG. 4, the pump 10 has a piston assembly designated as 20. The assembly 20 includes a first portion 22 having a piston 24 associated therewith. Piston 24 is preferably removably attached to the first portion 22 by a threaded stem so that pistons of different diameter may be readily attached thereto. Further, by removably attaching the piston to the first portion 22 it is possible to mass produce the remainder of the piston assembly as a standard item.

Figure 2:
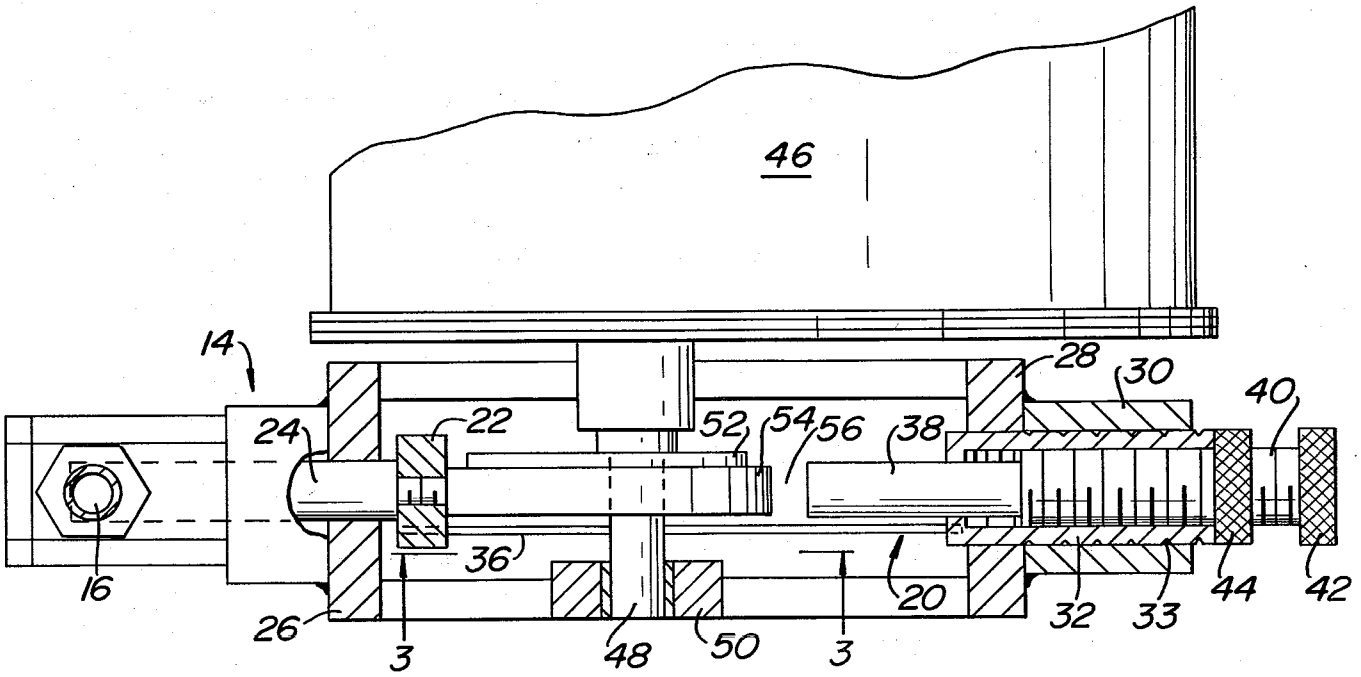
FIG. 2 is a sectional view taken along the line 2—2 in FIG. 1.

One end of the piston assembly 20 is supported by a header 26 on the housing 12. As shown more clearly in FIG. 2 the piston 24 extends through a hole in the header 26 into the portion 14. The other of the piston assembly 20 is supported by a similar header 28. The headers 26 and 28 support the piston assembly 24 for reciprocation along an longitudinal axis of the assembly 20. Headers 26, 28 each have hole 29 for receiving a fastener on a dust cover 31.

A cylindrical portion 30 is fixedly secured to the header 28 in any convenient manner such as by welding. See FIG. 2. A second portion 32 of the piston assembly 20 is guided for reciprocation by elements 28 and 30. The first portion 22 and the second portion 32 of the piston assembly 20 are coaxial and of the same diameter. Juxtaposed end faces of first portion 22 and second portion 32 are rigidly interconnected by a pair of third members 34, 36. The members 34, 36 are preferably commercially available wires or rods whose ends are metallurgically or otherwise bonded to the first and second portions. Such bonding may include welding, brazing, adhesive, etc. As shown more clearly in FIG. 2, the third portions 34 and 36 are disposed to one side of the longitudinal axis of the assembly 20. The juxtaposed end faces of portions 22 and 32 are annular with the portions 34, 36 being arcuately spaced from one another by approximately 90°.

The second portion 32 of the piston assembly 20 adjustably supports a coaxial stroke member 38. Stroke member 38 is integral in one piece with a larger diameter threaded portion 40. Portion 40 is coupled to mating threads on the inner periphery of the second portion 32. See FIG. 2. Portion 40 has a head 42 whose periphery is knurled to facilitate axial adjustment of stroke member 30 relative to the second portion 32. A lock nut 44 is provided on the threaded portion 40 for maintaining the stop member 38 in any preselected position. Portion 32 has calibrated grooves 33 on its periphery. The number of grooves 33 which are exposed indicates the effective length of the piston stroke which in turn indicates the pumping capacity. The stroke of piston assembly 20 may be adjusted while the pump is operating.

An electrical motor 46 has an output shaft 48. Shaft 48 is offset from the axis of housing 46 due to the presence of step down gearing in housing 46. Shaft 48 is supported at its free end in a bearing on the header 50 of the housing 12. Intermediate its ends, the shaft 40 is provided with an eccentric 52. Eccentric 52 has bearing races 54 on its outer periphery. The eccentric 52 with its coaxial races 54 is disposed in the gap 56 between one face of the first portion 22 and the end face of the stroke member 38.

As the eccentric 52 rotates, it causes the piston assembly 20 to reciprocate. As the piston assembly 20 reciprocates, the piston 24 causes a liquid to be sucked into portion 14 by way of the inlet 16 and be pressurized for subsequent discharge through the outlet 18. The piston 24 may be in direct contact with the liquid or may be spaced from the liquid by way of a diaphram in a known manner. Thus, the piston assembly of the present invention may be utilized in a metering pump for pumping liquids at high pressure and with low volume.

The first portion 22 and the second portion 34 are made from bar stock so as to require no external machining other than drilling coaxial holes therethrough and tapping such holes. The third portions 34, 36 are commercially available wire or rod stock that need only be cut to length and bonded at their ends to the portions 22 and 32 held coaxial in a jig. Thus, drilling and tapping coaxial holes in portions 22 and 32 are the only machine steps whereby capital equipment such as a lathe, a planer, milling equipment, etc. are not needed. The assembly can be produced much quicker with less skilled labor at a lower cost.

The present invention may be embodied in other specific forms without departing from the spirit or essential attributes thereof and, accordingly, reference should be made to the appended claims, rather than to the foregoing specification, as indicating the scope of the invention.

It is claimed:

1. A pump comprising a housing having an inlet and an outlet, a piston assembly including first and second discrete coaxial portions guided for reciprocation, only one of said portions being a piston arranged in a cylinder having inlet and outlet valves, said piston being adapted to pressurize liquid admitted through the inlet and discharged through the outlet, said portions being interconnected only by a pair of third portions, said third portions each having one end metallurgically bonded to one end face of said first portion and having its other end metallurgically bonded to one end face of said second portion, said third portions being disposed to one side of the axis of said first and second portions to thereby define a gap between said first and second portions, said second portion including a coaxial stroke member adjustably supported thereby for adjusting the effective length of said gap which determines the effective length of the piston stroke, a motor having an output shaft, an eccentric driven by said motor shaft, said eccentric being disposed in said gap between said stroke member and said first member for causing reciprocation of said piston, and said third portions being rods spaced apart for a sufficient distance so that an end of the output shaft on said motor extends there between, said shaft end being supported by a bearing on said housing.

2. A pump in accordance with claim 1 wherein said third members are rods spaced approximately 90° apart on the juxtaposed annular end faces of said first and second portions.

3. A pump in accordance with claim 2 wherein said third portions are metallurgically bonded to said first and second end portions by welding or brazing.

4. A piston assembly in accordance with claim 1 wherein said stroke adjustment member has a larger diameter threaded portion mating with threads on the inner periphery of said second portion.

5. In a pump comprising, a piston assembly including first and second discrete coaxial cylindrical portions guided for reciprocation, one of said portions including a piston arranged to pressurize a liquid, a motor having an eccentric, said eccentric being disposed in a gap between said coaxial portions for causing reciprocation of said piston, the improvement comprising said portions being interconnected solely by a pair of rods, said rods each having one end bonded by welding or brazing to one end of said first portion and having its other end bonded by welding or brazing to one end or said second portion, said rods being disposed to one side of the axis of said first and second portions in said gap between said first and second portions, said rods being arcuately spaced apart on the juxtaposed annular end faces of said first and second portions for a sufficient distance so that the output shaft on said motor can extend therebetween, and said second portion including a coaxial stroke member threadedly connected thereto for adjusting the effective length of said gap which determines the effective length of the piston stroke.

6. In a pump in accordance with claim 5 including calibrations on said second member to indicate the piston stroke length.

* * * * *